United States Patent [19]

Marshall

[11] 4,354,701

[45] Oct. 19, 1982

[54] GLAZIER'S PUNCH

[76] Inventor: Wilbur A. Marshall, Rte. 2, Box 96C, Aurora, Mo. 65605

[21] Appl. No.: 213,495

[22] Filed: Dec. 5, 1980

[51] Int. Cl.[3] ..... A47F 13/06
[52] U.S. Cl. ..... 294/1 R; 227/147
[58] Field of Search ..... 294/1 R, 15, 24; 227/53, 54, 141, 147; 81/463, 465

[56] References Cited

U.S. PATENT DOCUMENTS

| | | | |
|---|---|---|---|
| 210,511 | 11/1878 | Felfer | 227/147 |
| 1,340,705 | 5/1920 | De Lander | 227/147 |
| 1,465,139 | 8/1923 | Long | 227/147 |

*Primary Examiner*—James B. Marbert
*Attorney, Agent, or Firm*—Merlin B. Davey

[57] ABSTRACT

A glazier's punch having an inverted T-shape and a generally flat slightly longitudinally concave face, the punch being adapted for easy holding and for good contact with thin fasteners such as a glazier's point or small brad.

5 Claims, 4 Drawing Figures

GLAZIER'S PUNCH

BACKGROUND OF THE INVENTION

This application relates to hand tools and, more particularly, relates to a glazier's punch or set which can be readily made from a T-shaped bar.

SUMMARY OF THE INVENTION

Specifically, the invention relates to a glazier's punch having an inverted T-shape, a first end and a second end, and comprising a first or bottom portion integrally affixed to and connected with a second or top portion, which extends upwardly from said bottom portion, said bottom portion having a generally flat slightly inwardly linear curved or longitudinally concave face disposed oppositely to said top portion, said first end of said punch being adapted to contact a fastener means, such as a glazier's point or a small brad or staple, as for use in picture frames or window sash, and said second end of said punch being adapted to receive a driving force.

DETAILED DESCRIPTION OF THE INVENTION

Advantageously, the punch is held by the upwardly extending top portion of the inverted T. However, if desired, a transversely positioned holding element may be affixed to said top portion for still easier holding when in use. The inverted T-shape also allows greater separation between, e.g., the glass pane of a window and the stroke of a striking instrument when setting a point or fastener. The slightly inwardly linear curved or concave face of the base or bottom portion insures close contact of the first end of said punch with the work piece even when said work piece is a very thin fastener or point.

The invention is further illustrated by the accompanying drawing wherein.

Figure 1:
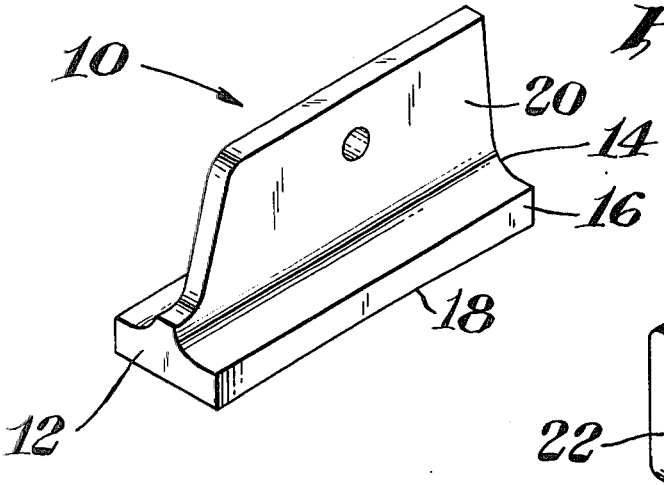
FIG. 1 is an isometric view of one embodiment of glazier's punch in accordance with this invention.

As shown in FIG. 1, a glazier's punch, 10, is provided from T-shaped bar. The punch, 10, has first end 12, a second end 14, a bottom portion 16 having a slightly longitudinally concave face 18 and a top portion 20. The top portion 20 is adapted to be held or grasped by the fingers of one hand, while end 14 is adapted to receive a driving force, as from a hammer, whereby the fastening means, which is, for example, a glazier's point or a small brad or staple, is driven into the location or position desired for it via contact with first end 12.

Figure 2:
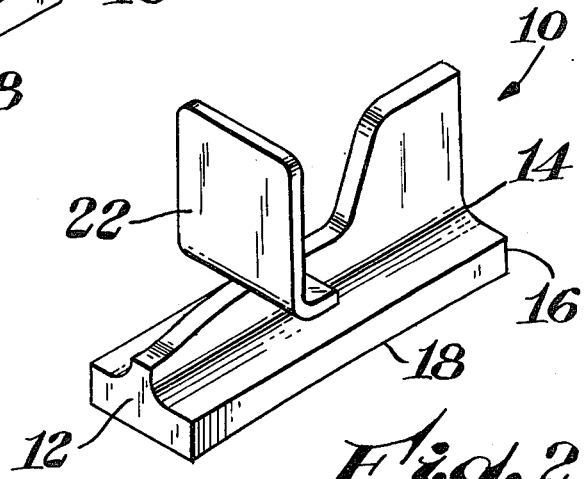
FIG. 2 is an isometric view of another embodiment of glazier's punch in accordance with this invention.

FIG. 2 depicts a different embodiment of the glazier's punch of this invention. In FIG. 2 a transverse portion 22 is shown affixed to top portion 20 of the glazier's punch. Transverse portion 22 serves as a holding element, as is readily apparent.

Figure 3:
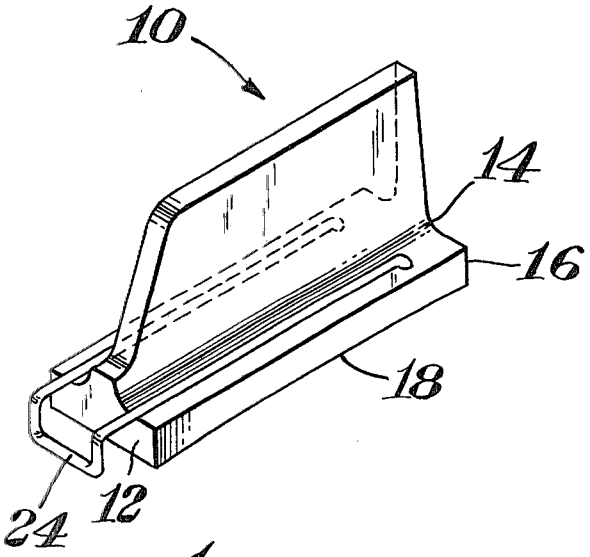
FIG. 3 is an isometric view of yet another embodiment of glazier's punch in accordance with this invention.

In FIG. 3 the glazier's punch is shown modified by including a resilient wire 24 which is so constructed as to assist in holding the fastening means in position against, for example, a window pane, until the fastening means is driven into position by applying a driving force to the second end 14 of the glazier's punch.

Figure 4:
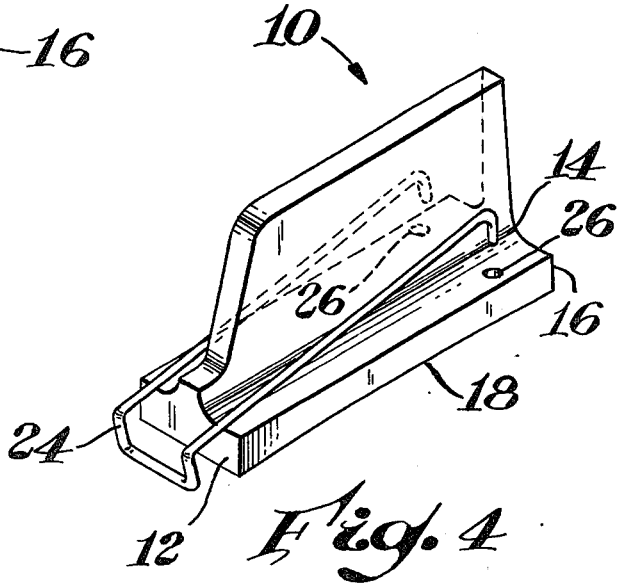
FIG. 4 is an isometric view of the embodiment of FIG. 3, illustrating one means of attaching a resilient wire.

In FIG. 4 the glazier's punch is shown with resilient wire 24 withdrawn from drilled holes 26, illustrating how the wire 24 may be inserted into holes 26 causing a tension on the wire which holds the glazier's point against, for example, a window pane.

WHAT IS CLAIMED IS:

1. A glazier's punch having an inverted T-shape, a first or bottom portion integrally affixed to and connected with a second or top portion which extends upwardly from said bottom portion, said bottom portion having a generally flat slightly longitudinally concave face disposed oppositely to said top portion, said first end of said punch being adapted to contact a fastener means, such as a glazier's point, and said second end of said punch being adapted to receive a driving force.

2. Punch of claim 1, wherein a transversely positioned holding element is affixed to said top portion.

3. Punch of claim 1 further comprising a spring member which is adapted to contact said fastener means and hold said fastener means in position, while said fastener means is being driven into the desired location.

4. Punch of claim 3, wherein said spring member comprises a U-shaped wire, the open ends of which are affixed to said bottom portion on opposite sides of said top portion.

5. Punch of claim 4, wherein the closed end of the U-shaped wire is bent downwardly just beyond said first end of said punch.

* * * * *